US009708169B2

(12) United States Patent
Meinzinger et al.

(10) Patent No.: US 9,708,169 B2
(45) Date of Patent: Jul. 18, 2017

(54) APPARATUS FOR THE REMOVAL OF LIQUIDS FROM CONTAINERS

(71) Applicant: KRONES AG, Neutraubling (DE)

(72) Inventors: Rupert Meinzinger, Kirchroth (DE); Ute John-Unterburger, Suenching (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 14/650,256

(22) PCT Filed: Dec. 5, 2013

(86) PCT No.: PCT/EP2013/075687
§ 371 (c)(1),
(2) Date: Jun. 5, 2015

(87) PCT Pub. No.: WO2014/086931
PCT Pub. Date: Jun. 12, 2014

(65) Prior Publication Data

US 2015/0315004 A1 Nov. 5, 2015

(30) Foreign Application Priority Data

Dec. 5, 2012 (DE) ..... 10 2012 111 845

(51) Int. Cl.
*B67D 1/00* (2006.01)
*B67D 1/08* (2006.01)

(52) U.S. Cl.
CPC ..... *B67D 1/0001* (2013.01); *B67D 1/0829* (2013.01); *B67D 1/0891* (2013.01)

(58) Field of Classification Search
CPC .. B67D 1/0001; B67D 1/0829; B67D 1/0891; B67D 7/0216
See application file for complete search history.

(56) References Cited

U.S. PATENT DOCUMENTS 3,904,083 A * 9/1975 Little ..... B67B 7/24 222/326
4,898,302 A * 2/1990 Byerly ..... B29B 13/022 222/108

(Continued)

FOREIGN PATENT DOCUMENTS

DE 69402298 10/1997
DE 20001409 4/2000

(Continued)

OTHER PUBLICATIONS

International Search Report and Written Opinion (no translation) issued in application No. PCT/EP2013/075687, dated Apr. 23, 2014 (10 pgs).

*Primary Examiner* — Frederick C Nicolas
*Assistant Examiner* — Bob Zadeh
(74) *Attorney, Agent, or Firm* — Hayes Soloway P.C.

(57) ABSTRACT

An apparatus for the removal of liquids from deformable containers includes a first holding device for holding a first region of a container, and a second holding device for holding a second region of the container. The second region is arranged at a distance from the first region, with a removal device for removing liquid from the container and with a drive device which moves the second holding device in a pre-set direction of movement (L) with respect to the first holding device. The removal device is arranged on the second holding device in a removable manner and a support element is provided which supports at least one element of the removal device in the direction of movement (L) in a removal operation.

16 Claims, 3 Drawing Sheets

(56) References Cited

U.S. PATENT DOCUMENTS

| | | | | | |
|---|---|---|---|---|---|
| 5,505,336 | A * | 4/1996 | Montgomery | B67D 1/0001 | 222/326 |
| 5,553,740 | A * | 9/1996 | King | B67D 1/0001 | 222/1 |
| 5,617,977 | A | 4/1997 | Augustinus | 222/400.7 | |
| 6,131,766 | A * | 10/2000 | King | B67D 7/0227 | 222/1 |
| 7,950,920 | B2 * | 5/2011 | Vale | F23D 11/36 | 126/4 |
| 2010/0059544 | A1 * | 3/2010 | Dijkstra | B65D 83/0077 | 222/95 |
| 2012/0104020 | A1 * | 5/2012 | Cur | B67D 1/0001 | 222/1 |
| 2015/0315004 | A1 * | 11/2015 | Meinzinger | B67D 1/0001 | 222/95 |

FOREIGN PATENT DOCUMENTS

| | | | | |
|---|---|---|---|---|
| DE | 202009003487 | | 6/2009 | |
| GB | 2178001 | | 2/1987 | |
| GB | 2436828 | | 10/2007 | |
| NL | WO 2009115965 | A2 * | 9/2009 | B67D 1/0001 |
| WO | WO9806659 | A2 | 2/1998 | |
| WO | WO9806659 | A3 | 2/1998 | |
| WO | WO2005113418 | | 12/2005 | |
| WO | WO2009115965 | | 9/2009 | |
| WO | WO2010014004 | A2 | 2/2010 | |
| WO | WO2010014004 | A3 | 2/2010 | |
| WO | WO2012010659 | | 1/2012 | |
| WO | WO2012168525 | | 12/2012 | |

* cited by examiner

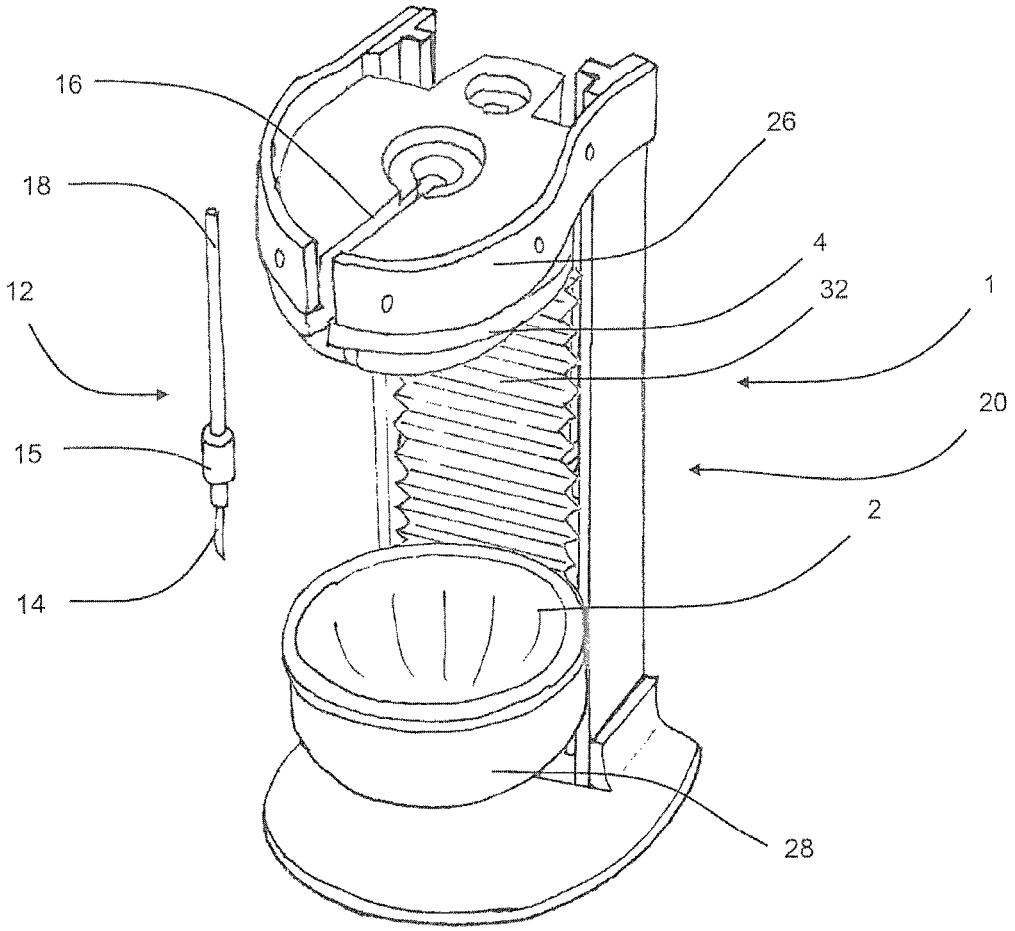
Fig. 1
Fig. 1a
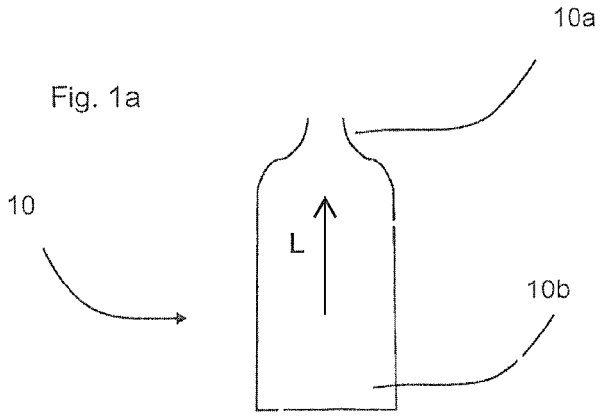

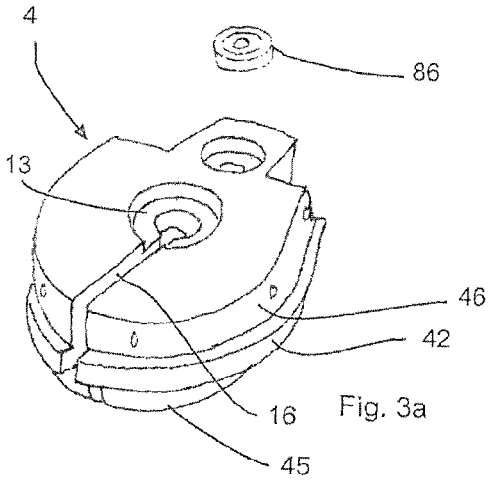
Fig. 3a
Fig. 3b
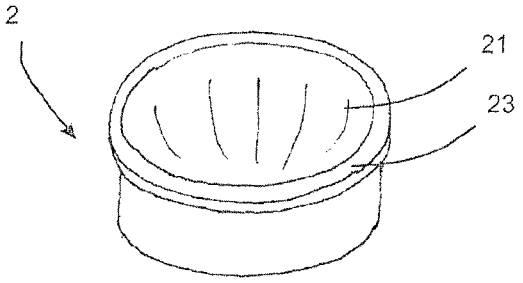
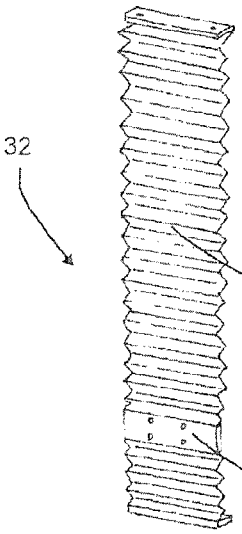
Fig. 3c
Fig. 3d
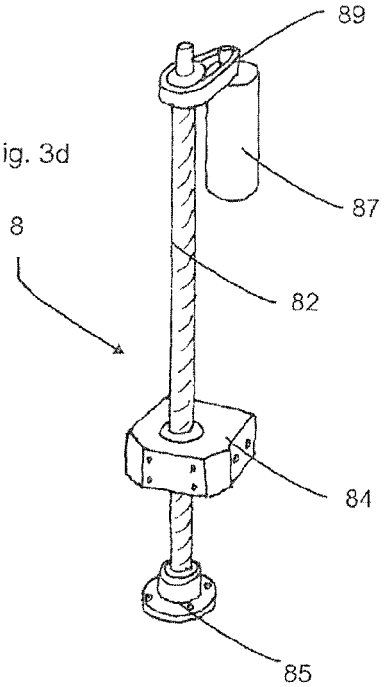
Fig. 3e
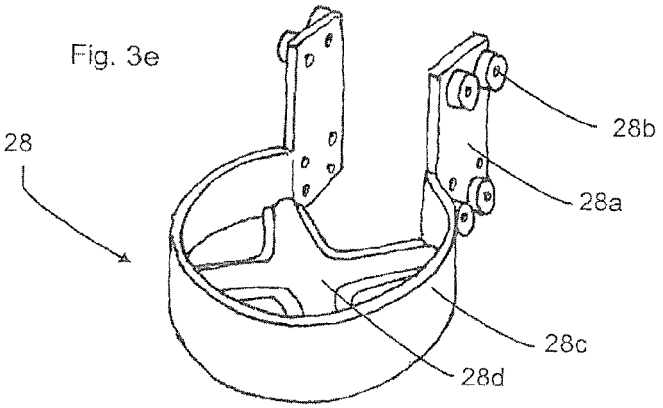

APPARATUS FOR THE REMOVAL OF LIQUIDS FROM CONTAINERS

BACKGROUND OF THE INVENTION

The present invention relates to an apparatus for the removal of liquids from containers. Apparatus of this type have long been known from the prior art. In addition, apparatus are known from the prior art which take the liquid out of the containers in such a way that the containers are compressed during the removal. Apparatus of this type frequently have two holding devices which are movable with respect to each other, as well as a removal device which can penetrate for example through a wall or a closure of the container into the latter in order to remove the liquid in this way. Frequently, however, it is relatively difficult to clean these removal devices.

The object of the present invention is therefore to make available an apparatus for the removal of liquids from deformable containers, and in particular from plastics material containers, which permits or facilitates respectively an invariably hygienic removal of the liquid.

SUMMARY OF THE INVENTION

An apparatus according to the invention for the removal of liquids from deformable containers, and in particular from plastics material containers, has a first holding device for holding a first region of a container, and a second holding device for holding a second region of the container, this second region of the container being arranged at a distance from the first region of the container. In addition, the apparatus has a removal device for removing liquid from the container as well as a drive device which moves the second holding device in a pre-set direction of movement with respect to the first holding device.

According to the invention the removal device is arranged on the second holding device in a removable manner and, in addition, a support element is provided which supports at least one element of the removal device in the direction of movement in a removal operation.

By virtue of the proposed removability of the removal device a very easy and convenient cleaning of this removal device is possible, and it is not necessary for a separate rinsing operation of the apparatus to be carried out for this.

In particular, the support element supports the removal device or a removal element respectively during a compression procedure of the container, so that, if the removal device is arranged above the container, the latter for example cannot escape upwards. It is advantageous for the first holding device to hold a base region of the container and for the second holding device to hold a shoulder region. In this case this support element and preferably also the removal device itself is or are designed in particular in such a way as to withstand a counter pressure during the opening of the container and during the compression of the container. By way of example, this support element could be designed in the form of a radial taper, against which a radial projection of a removal element is supported. In the case of a further advantageous embodiment the removal device has a cutting element which is suitable and provided for penetrating through a container closure.

In addition, however, a further holding means (not shown) is also provided, which prevents the removal device from falling out downwards, provided that no container is present in the apparatus. It would also be possible for the removal device first to be inserted into the holding device and then for a cover element for example to be turned down, which prevents a movement of the removal device upwards or away from the container respectively.

During the movement of the two holding devices with respect to each other it would be possible for only one holding device, i.e. the first or the second holding device, to be moved, but it would also be possible for the two holding devices to be moved towards each other or away from each other respectively.

In the case of an advantageous embodiment the second holding device has a groove which extends at an angle different from 0° with respect to the longitudinal direction and by way of which the at least one element of the removal device is capable of being inserted into the second holding device. In this embodiment it is proposed that the holding device should have a groove or a slot respectively which serves, in particular, for the mounting of the removal device or a removal element respectively.

It is therefore preferable for the removal device to be capable of being inserted through a groove and also capable of being removed through this groove again.

In the case of a further advantageous embodiment the groove extends at least locally in a radial direction of the second holding device. It is advantageous for the aforesaid groove to extend in a straight line and, in a particularly preferred manner, at a right angle to the longitudinal direction named above. It is particularly preferred for the groove also to extend in the longitudinal direction, or preferably to form a plane which covers both the longitudinal direction and the aforesaid radial direction or which is spanned by these directions respectively.

In the case of a further advantageous embodiment the apparatus has a carrier on which at least one holding device is arranged in a releasable manner. It is advantageous for the two holding devices to be arranged on the carrier in a releasable manner. In this way, the apparatus can be adapted to different dimensions of container. For this purpose the holding device can have support elements or receiving elements respectively for receiving the holding device. In this case it is possible for these holding devices to be fixed on these support elements, for example to be screwed to them.

It is advantageous for the carrier to be a welded structure which can therefore be designed in a relative stable manner.

It is advantageous for the apparatus according to the invention to be suitable in particular for filling quantities of containers of between 0.5 l and 5 l, preferably between 1 l and 3 l, the use not being limited to these filling quantities of container.

In the case of a further advantageous embodiment the carrier has a guide device which guides the movement of at least one holding device in the direction of movement. In this way for example, a guide rail can be provided, with respect to which a holding device can roll by means of suitable guide bodies, such as for example rollers. It is advantageous for the direction of movement described also to be a longitudinal direction of the container from which liquid is to be removed. It is advantageous for the holding devices to be movable with respect to each other along a straight direction.

In the case of a further advantageous embodiment the carrier has a C-shaped profile, the arms of this C being, in particular, the support devices for the two holding devices. In this way, the apparatus can be formed with a highly compact design.

In the case of a further advantageous embodiment the carrier has a receiving element for receiving the second holding device and this holding device preferably also has a gap for the passage of the removal element. This means that it is possible for the second holding device first to be arranged on the carrier and only then for the removal device to be inserted.

In the case of a further advantageous embodiment the drive device has at least one rotatable drive spindle and preferably precisely one rotatable drive spindle. This drive spindle is used in this case for moving the two holding devices with respect to each other. It is advantageous for this one drive spindle to be driven by an electric motor and, in particular, by way of a belt.

In the case of a further advantageous embodiment the removal device has a flexible hose element. In this case this flexible hose element can be attached to a removal body which has for example a cutting element which is used for piercing a container closure. It is advantageous for at least one element of the holding device to be designed in the form of a one-way element. It is advantageous for at least the hose element mentioned above to be designed in the form of a one-way element, i.e. a complicated cleaning of this hose element can be avoided. It would also be possible, however, for the piercing element for example to be designed in the form of a one-way member.

BRIEF DESCRIPTION OF THE DRAWINGS

Further advantages and embodiments are evident from the accompanying drawings. In the drawings FIG. 1 is an overall illustration of an apparatus according to the invention;

FIG. 1*a* is a diagrammatic illustration of a container to be emptied according to the invention;

FIGS. 3*a* to 3*e* are illustrations of component parts of the apparatus according to the invention.

DETAILED DESCRIPTION OF THE INVENTION

Figure 2A:
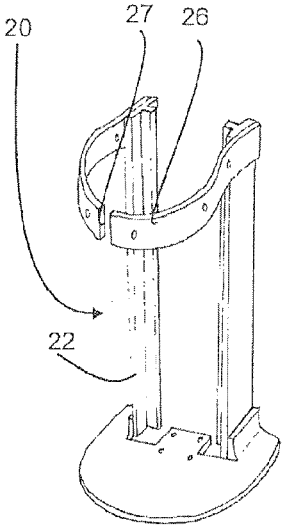
FIGS. 2*a* to 2*e* show mounting steps to explain the assembly of an apparatus according to the invention.

FIG. 1 is an illustration of an apparatus 1 according to the invention. This apparatus 1 has in this case a carrier 20 on which is arranged a first holding device 2 which receives a first region or base 10*b* of a container 10. This first holding device is arranged in this case on a carrier 28. The reference number 4 designates a second holding device which is used for receiving a second region, i.e., a shoulder or aperture region 10*a* of the container, arranged at a distance from the first region or base 10*b*. In this case this second holding device preferably has a recess (not visible) into which an aperture portion of the container can engage so that the container is also centred by the holding device 4 in this way. The holding device 4 is arranged in turn on a carrier element 26.

It is further evident that the second holding device 4 has a radially extending groove 16 by way of which the removal device designated 12 as a whole can be inserted into the holding device 4. In this case the removal device 12 has a holding element 15 which can be supported with respect to the holding device 4 or a support element respectively of the holding device 4 in such a way that it is fixed and, in particular, cannot be moved upwards in FIG. 1. In this way, a piercing element 14 can penetrate into the container and thus remove liquid from the container. The reference number 18 designates a hose which is likewise a component part of the removal device 12 and by way of which the beverage or the liquid respectively can be removed from the container.

The reference number 32 designates a cover member, by means of which the mechanism and, in particular, the drive (not shown here) are covered.

In the case of an advantageous embodiment the geometrical shape of the second holding device 4 is adapted to a geometrical shape of the first holding device 2, so that when the holding devices 2, 4 are brought together by movement of holding device 2 arranged on slide 84 on drive spindle 82 (see FIGS. 2*c* and 2*d*) the container can be substantially emptied. In addition, it is advantageous for no guides or the like to be provided in the region of the container between the two holding devices 2 and 4. The Applicant has established that the plastics material containers have an adequate degree of stability and need not be supported laterally. On the other hand, supports of this type would also make the movements of the holding devices with respect to each other difficult. The second holding device 4 is preferably designed in the form of a ram which enters a region of the first holding device 2 when the holding devices are moved together.

FIG. 1*a* is a roughly diagrammatic illustration of a container 10 to be emptied. This container 10 has in this case a base region 10*b* as well as a shoulder region 10*a* in which the aperture of the container is also situated, as well as a closure (not shown) which is pierced by the piercing device 14 when the container 10 is emptied. It would also be possible, however, for the container 10 first to be connected to the piercing device 14 and optionally also opened by the user and then for the removal device 12 to be guided into the interior of the container.

FIGS. 2*a* to 2*e* show mounting steps for the assembly of an apparatus according to the invention. In this case only those components which are newly added as compared with the preceding figure are provided with reference numbers in the figures following in succession in each case. The carrier 20 is illustrated in FIG. 2*a*. This carrier 20 has in this case a guide rail 22 which is used to guide the movement of the first holding device. In addition, the carrier element 26 is provided which is used for receiving the second holding device. This support element has in this case a slot 27 through which the removal device 12 can be inserted.

Figure 2B:
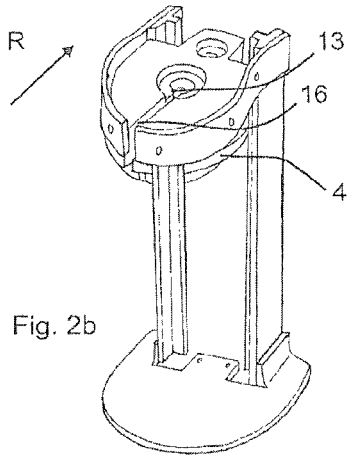

In the case of the illustration reproduced in FIG. 2*b* the second holding device 4 has now been inserted. In this case too, the radially extending groove 16 by way of which the removal device can be inserted, in this case likewise in the radial direction R, is again evident. This radial direction has been shown for clarification, more precisely a direction R parallel to the radial direction.

The reference number 13 refers to a support element which is likewise arranged in the holding device 4. The removal device, more precisely the body of the removal device shown in FIG. 1, can be supported with respect to this support element 13, so that the latter cannot give way upwards during the emptying procedure of the container. It would also be possible in this case for the portion 15 shown in FIG. 1 to be made tapered and also for the support element to form a tapered internal cross-section.

Figure 2C:
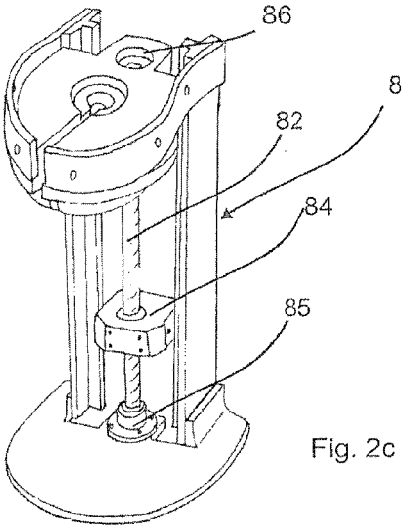

In FIG. 2*c* the drive 8 has now been additionally fitted.

This drive 8 has a drive spindle 82 on which is arranged a slide 84, a movement of the slide 84 in the longitudinal direction L of the container, i.e. upwards and downwards in this case, being caused by a rotation of the drive spindle 82. The reference number 85 refers to a lower guide of the drive spindle 82 and the reference number 86 to an upper guide which in this case is arranged in the second holding device 4. A carrier for holding the first holding device 2 can be arranged on the slide 84. In the case of the embodiment shown here the second holding device 4 is arranged in a stationary manner and the first holding device 2 is moved upwards in order to empty the container.

Figure 2D:
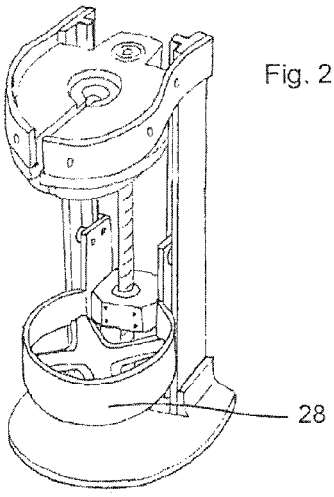

In FIG. 2*d* the carrier or the carrier element 28 respectively, which is used for holding the first holding device 2, is now also fitted.

Figure 2E:
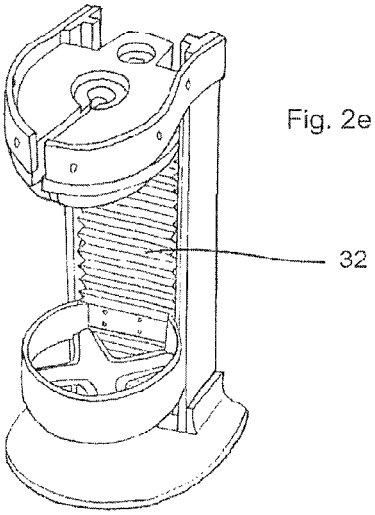

In the illustration reproduced in FIG. 2*e* a flexible cover 32 which covers the drive 8 has also been inserted. Finally, the lower holding device 2 is also inserted in order to arrive at the apparatus 1 shown in FIG. 1.

FIGS. 3*a* to 3*e* are individual illustrations of the components of the apparatus according to the invention. In this case the second holding device 4 is again shown in FIG. 3*a*. This second holding device 4 has a mounting plate 46 which can be screwed for example into or with the carrier element 26 shown in FIG. 2*a*. The reference number 42 designates a further plate which is arranged on the mounting plate 46 and which projects laterally beyond the mounting plate 46 and is thus supported against a lower edge of the upper carrier element 26. In this way, the holding device can be further prevented from slipping upwards during the removal procedure. The reference number 45 designates the actual ram element which has a recess (not shown) into which a shoulder and aperture region of the container engages. It is preferable for this ram element to have a curved shape which in a particularly preferred manner is adapted to a corresponding shaping of the first holding device 2.

FIG. 3*b* is an illustration of the first holding device 2. In this case the shape of the base, which can be adapted for example to the contour of a container to be emptied, is evident. A continuous edge 23 can be supported against the lower carrier 28 during operation. In this case it is possible for the first holding device 2 to be raised in a simple manner from the carrier 28 thereof for dismantling and to be replaced in a simple manner in this way.

FIG. 3*c* designates the cover 32. The latter has in this case a flexible or foldable element 32*a* as well as also a fastening means 32*b* which is used for fastening to the slide 84 on one side and to the carrier 28. During operation this fastening means 32*b* can be shifted upwards during the removal, without the cover 32 being pulled away.

FIG. 3*d* is an illustration of the drive or the drive device respectively of the apparatus. In this case the spindle 82 is again shown as well as the slide 84. Furthermore, a drive motor 87 is shown, for example an electric motor, which drives the spindle 82 by way of a drive belt 89.

FIG. 3*e* is an illustration of the lower carrier device 28. The latter has a lateral guide element 28*a* as well as a plurality of rollers 28*b* which receive between themselves a corresponding web of the guide 22. In this way, a lateral guidance of the longitudinal movement of the carrier 28 and thus also of the first holding device 2 is provided. The reference 28*c* designates a receiving ring which receives the first holding device 2. The reference 28*d* designates a support device which also supports the holding device at the bottom.

The Applicant reserves the right to claim all the features disclosed in the application documents as being essential to the invention, insofar as they are novel either individually or in combination as compared with the prior art.

LIST OF REFERENCES

1 apparatus
2 first holding device
4 second holding device
8 drive
10 container
10*a* shoulder region
10*b* base region
12 removal device
13 support element
14 piercing element
15 holding element
16 groove
18 hose
20 carrier
22 guide rail
23 continuous edge
26 support element
27 slot
28 carrier
28*a* lateral guide element
28*b* rollers
28*c* receiving ring
28*d* support device
32 cover member
32*a* foldable element
32*b* fastening means
42 plate
45 ram element
46 mounting plate
82 drive spindle
84 slide
85 lower guide
86 upper guide
87 drive motor
89 drive belt
R radial direction
L longitudinal direction

The invention claimed is:

1. An apparatus for the removal of liquids from deformable containers, with a first holding device for holding a first region of a container, with a second holding device for holding a second region of the container, wherein the second region is arranged at a distance from the first region, with a removal device for removing liquid from the container and with a drive device which moves the first holding device in a pre-set direction of movement (L) towards the second holding device, wherein the removal device is arranged on the second holding device and is removable as a whole from the second holding device, and a support element is provided which supports at least one element of the removal device in the direction of movement (L) in operation, wherein the second holding device has a groove which originates from a midpoint section of the second holding device and extends through said second holding device in a radial direction to form a radial extending slit within the second holding device wherein the removal device is capable of being inserted into and removed through the groove.

2. The apparatus according to claim 1, wherein the apparatus has a carrier on which at least one of the first holding device and the second holding device is arranged in a releasable manner.

3. The apparatus according to claim 2, wherein the carrier has a guide device which guides the movement of at least one holding device in the direction of movement (L).

4. The apparatus according to claim 2, wherein the carrier has a C-shaped profile.

5. The apparatus according to claim 2, wherein the drive device has at least one rotatable drive spindle.

6. The apparatus according to claim 2, wherein the removal device has a flexible hose element.

7. The apparatus according to claim 2, wherein at least one element of the removal device is designed in the form of a one-way element.

8. The apparatus according to claim 2, wherein the drive device comprises a single rotatable drive spindle.

9. The apparatus according to claim 1, wherein the first holding device is adapted to receive a base region of the container, and the second holding device is adapted to receive a shoulder region of the container.

10. The apparatus according to claim 1, wherein the support element has a radially extending groove against which a radial projection of the removal device is supported.

11. The apparatus according to claim 1, wherein the removal device has a cutting element for penetrating through a container closure.

12. The apparatus according to claim 1, wherein the groove extends in a straight line and at a right angle to a longitudinal direction from a midpoint section of said second holding device.

13. The apparatus of claim 1, wherein the groove extends in both a longitudinal direction and a radial direction.

14. The apparatus of claim 1, wherein the space between a first holding device and the second holding device is open.

15. An apparatus for the removal of liquids from deformable containers, with a first holding device for holding a first region of a container, with a second holding device for holding a second region of the container, wherein the second region is arranged at a distance from the first region, with a removal device for removing liquid from the container and with a drive device which moves the first holding device in a pre-set direction of movement (L) relative towards the second holding device, wherein the removal device is arranged on the second holding device and is removable as a unit from the second holding device, and a support element is provided which supports at least one element of the removal device in the direction of movement (L) in operation, wherein the second holding device includes a mounting plate which is attached to a carrier element, which carrier element in turn is supported on a guide rail.

16. The apparatus according to claim 15, wherein an additional plate is mounted on the mounting plate, which additional plate projects laterally beyond the mounting plate, and supported against a lower edge of the carrier element, whereby prevent the first holding element from slipping upwards when the removal device is in operation.

* * * * *